US006461566B2

(12) United States Patent
Pfannenmüller et al.

(10) Patent No.: US 6,461,566 B2
(45) Date of Patent: Oct. 8, 2002

(54) ALUMINUM-BASED ALLOY AND PROCEDURE FOR ITS HEAT TREATMENT

(75) Inventors: Thomas Pfannenmüller, Ottobrunn (DE); Erwin Loechelt, Bremen (DE); Peter-Jürgen Winkler, Ottobrunn (DE); Sergej Mikhajlovich Mozharovskij, Gebiet Sverdlov (RU); Dmitrij Sergejevich Galkin, Moskauer Gabiet (RU); Elena Glebovna Tolchennikova, Moskauer Gabiet (RU); Vladimir Mikhajlovich Chertovikov, Moskau (RU); Valentin Georgijevich Davydov, Moskau (RU); Evgenij Nikolajevich Kablov, Moskau (RU); Larisa Bagratovna Khokhlatova, Moskau (RU); Nikolay Ivanovich Kolobnev, Moskau (RU); Iosif Naumovich Fridlyander, Moskau (RU)

(73) Assignees: Eads Deutschland GmbH, Munich (DE); Viam (All Russian Institute of Aviation Materials), Moscow (KR)

( * ) Notice: Subject to any disclaimer, the term of this patent is extended or adjusted under 35 U.S.C. 154(b) by 0 days.

(21) Appl. No.: 09/994,273

(22) Filed: Nov. 26, 2001

(65) Prior Publication Data

US 2002/0056493 A1 May 16, 2002

Related U.S. Application Data

(62) Division of application No. 09/509,181, filed as application No. PCT/EP98/06010 on Sep. 21, 1998, now Pat. No. 6,395,111.

(30) Foreign Application Priority Data

Sep. 22, 1997 (RU) ..... 97116302
Mar. 5, 1998 (RU) ..... 98104394

(51) Int. Cl.[7] ..... C22C 21/06

(52) U.S. Cl. ..... 420/532; 420/541; 420/543; 420/545

(58) Field of Search ..... 420/532, 541, 420/543, 545

(56) References Cited

U.S. PATENT DOCUMENTS

| | | | | |
|---|---|---|---|---|
| 4,431,467 A | | 2/1984 | Staley et al. | 148/159 |
| 4,584,173 A | | 4/1986 | Gray et al. | 420/533 |
| 4,636,357 A | | 1/1987 | Peel et al. | 420/532 |
| 4,840,682 A | | 6/1989 | Curtis et al. | 148/12.7 |
| 4,861,391 A | | 8/1989 | Rioja et al. | 148/12.7 |
| 5,076,859 A | | 12/1991 | Rioja et al. | 148/12.7 A |
| 5,133,931 A | * | 7/1992 | Cho | 420/541 |
| 5,226,983 A | | 7/1993 | Skinner et al. | 148/549 |
| 5,413,650 A | | 5/1995 | Jarrett et al. | 148/690 |
| 5,676,773 A | * | 10/1997 | Webster | 148/415 |
| 5,879,481 A | | 3/1999 | Price | 148/698 |

FOREIGN PATENT DOCUMENTS

| | | |
|---|---|---|
| WO | 9203583 | 3/1992 |
| WO | 9532074 | 11/1995 |
| WO | 9618752 | 6/1996 |

* cited by examiner

*Primary Examiner*—Roy King
*Assistant Examiner*—Janelle Combs Morillo
(74) *Attorney, Agent, or Firm*—Ladas & Parry

(57) ABSTRACT

An aluminum-based alloy having the following composition, % w/w:

| | |
|---|---|
| Lithium | 1.5–1.9 |
| Magnesium | 4.1–6.0 |
| Zinc | 0.1–1.5 |
| Zirconium | 0.05–0.3 |
| Manganese | 0.01–0.8 |
| Hydrogen | $0.9 \times 10^{-5}$–$4.5 \times 10^{-5}$ |

and at least one element selected from the following group:

| | |
|---|---|
| Beryllium | 0.001–0.2 |
| Yttrium | 0.01–0.5 |
| Scandium | 0.01–0.3 |
| Aluminum | Remainder |

The process of heat treating the alloy includes the steps of quenching the alloy from a temperature of 400–500° C. in cold water or air, stretched-adjusting it to increase ductility up to 0 2 %, and a three stage heat treatment, in which in stage 1 the alloy is heated at 80–90° C. over the course of 3–12 h, in stage 2 it is heated at 110–185° C. over the course of 10–58 h, and in stage 3 it is heated at 90–110° C. for 14 h, or at a cooling rate of 2–8° C. C/h.

3 Claims, No Drawings

ALUMINUM-BASED ALLOY AND PROCEDURE FOR ITS HEAT TREATMENT

This application is a divisional of U.S. patent application Ser. No. 09/509,181 filed Jul. 13, 2000 now U.S. Pat. No. 6,395,111.

The invention relates to an aluminum-based alloy, preferably from the Al—Li—Mg system, which contains lithium, magnesium, zinc, zirconium and manganese, and relates to the metallurgy of alloys used as a construction material in aeronautics and aerospace engineering, in shipbuilding and mechanical engineering of earthbound means of transportation, including welding structures.

Known in the art are alloys of the system Al—Li—Mg that exhibit a reduced density and relatively high strength, but have a low ductility and diminished fracture toughness. The alloy according to U.S. Pat. No. 4,584,173 dated Apr. 22, 1986 has the following chemical composition, %w/w:

| Aluminum | Base |
|---|---|
| Lithium | 2.1–2.9 |
| Magnesium | 3.0–5.5 |
| Copper | 0.2–0.7 |

and one or more elements from the group containing zirconium, hafnium and niobium:

| | |
|---|---|
| Zirconium | 0.05–0.25 |
| Hafnium | 0.10–0.50 |
| Niobium | 0.05–0.30 |
| and | |
| Zinc | 0–2.0 |
| Titanium | 0–0.5 |
| Manganese | 0–0.5 |
| Nickel | 0–0.5 |
| Chromium | 0–0.5 |
| Germanium | 0–0.2 |

If this alloy is quenched at a temperature of 530° C. and then stretch-adjusted with a ductility of 2% and artificially aged at 190° C. for 4–16 h, the disadvantage is that the alloy exhibits low ductility in the heat-treated state (relative elongation 3.1–4.5%) and low corrosion resistance.

The alloy according to International Patent Application WO No. 92/03583 has the following chemical composition in %w/w:

| Aluminum | Base |
|---|---|
| Lithium | 0.5–3.0 |
| Magnesium | 0.5–10.0 |
| Zinc | 0.1–5.0 |
| Silver | 0.1–2.0 |

At a max. 12% total content of these elements and, when they measure 7.0–10.0% in sum, lithium cannot exceed 2.5%, and zinc 2.0%; in addition, the alloy can contain up to 1.0% zirconium.

This alloy exhibits a strength of 476–497 MPa, an apparent yield point of 368–455 MPa, a relative elongation of 7–9% and a density of 2.46–2.63 g/cm$^3$. The alloy is recommended as a structural material for products in aeronautics and aerospace. The disadvantages to this alloy are as follows:

The high strength can be ensured:

by a high lithium content, but this reduces the ductility and fracture toughness of the alloy, diminishes its cold formability, and difficulties are encountered during the manufacture of thin sheets required for flying devices;

by a high zinc content; this increases the alloy density to values of 2.60–2.63 g/cm$^3$, which significantly diminishes the savings in weight for the product;

by stretching the quenched material prior to an artificial ageing with a degree of ductility of 5–6%, which diminishes the fracture toughness parameters.

The alloy is alloyed with silver, which increases the product costs, from semi-finished to finished products.

Alloys with a high zinc content and added copper exhibit a diminished corrosion resistance; during fusion welding, they show an increased tendency to form defects and a distinct loss of cohesion.

A comparable alloy for the entire area of application is known from U.S. Pat. No. 4,636,357. This alloy has the following composition, %w/w:

| Aluminum | Base |
|---|---|
| Lithium | 2.0–3.0 |
| Magnesium | 0.5–4.0 |
| Zinc | 2.0–5.0 |
| Copper | 0–2.0 |
| Zirconium | 0–0.2 |
| Manganese | 0–0.5 |
| Nickel | 0–0.5 |
| Chromium | 0–0.4 |

The alloy is hardened via heat treatment:

Quenching at a temperature of 460° C., stretching with a stretching degree of 0–3% and a two-stage heat treatment:

Stage 1 at 90° C., 16 h and stage 2 at 150° C., 24 h.

This alloy exhibits a sufficiently high level of strength of 440–550 MPa and an apparent yield point of 350–410 MPa.

The disadvantages to this alloy include the low level of relative elongation of the alloy (1.0–7.0%) and the low fracture toughness, inadequate corrosion resistance and limited strength of welds in comparison to the strength of the base material.

Therefore, the object of the present invention is to achieve an increased ductility for the alloy in a heat-treated state while retaining a high strength and ensuring a high corrosion resistance and weldability, at the same time ensuring sufficiently high parameters for fracture toughness and thermal stability after warming at 85° C. over the course of 1000 h.

This object is achieved according to the invention by an alloy from the Al—Li—Mg system with the following chemical composition, %w/w:

| | |
|---|---|
| Lithium | 1.5–1.9 |
| Magnesium | 4.1–6.0 |
| Zinc | 0.1–1.5 |
| Zirconium | 0.05–0.3 |
| Manganese | 0.01–0.8 |
| Hydrogen | $0.9 \times 10^{-5}$–$4.5 \times 10^{-5}$ |

and at least one element selected from the following group:

| | |
|---|---|
| Beryllium | 0.001–0.2 |
| Yttrium | 0.01–0.5 |
| Scandium | 0.01–0.3 |
| Aluminum | Remainder |

As solid, finely distributed lithium hydride particles form, the hydrogen content reduces the contraction during solidification, and prevents the formation of porosity in the material.

The magnesium content ensures the necessary level of strength characteristics and weldability. If the magnesium content drops below 4.1%, strength will decrease, and the tendency of the alloy to form hot cracks both during casting and welding will rise. Increasing the magnesium content in the alloy to over 6.0% diminishes processability during casting, hot and cold rolling, and the plasticity parameters of completed semi-finished products and articles made from them.

Maintaining the lithium content is important to ensure the required processability, in particular during them manufacture of thin sheets, the necessary level of mechanical and corrosion characteristics, and sufficient fracture toughness and weldability. A drop in lithium content to below 1.5% increased the alloy density, diminished the level of strength characteristics and the modulus of elasticity. A lithium content exceeding 1.9% was associated with diminished processability via cold forming, weldability, plasticity parameters and fracture toughness.

0.05–0.3% zirconium is a modifier during the casting of ingots, and together with manganese (0.01–0.8%) ensures a structural solidification in the semi-finished products due to the formation of a polygonized or fine-grained structure.

In particular adding one or more of the elements beryllium, yttrium and scandium yields the formation of a homogeneous, fine-grained structure in semi-finished products comprised out of the alloy according to the invention, and an increased ductility during cold-rolling.

The invention also relates to a procedure for heat-treating aluminum-based alloys, preferably from the Al—Li—Mg system.

The object of such a heat-treatment procedure is to increase the ductility of the alloy while retaining its high strength, and simultaneously achieve high parameters for corrosion resistance and fracture toughness, but in particular to preserve these characteristics when exposing the material to an elevated temperature over a prolonged time.

Known from U.S. Pat. No. 4,861,391 is a procedure for heat treatment, which involves quenching with rapid cooling, stretching and two-stage ageing as follows:

Stage 1 at a temperature not to exceed 93° C., from several hours to several months; preferably 66–85° C., at least 24 h.

Stage 2 at a max. temperature of 219° C., from 30 minutes to several hours, 154–199° C., max. 8 h.

While the strength parameters and fracture toughness are increased, this procedure does not ensure stability with respect to the characteristics of lithium-containing aluminum alloys after low-temperature warming at 85° C. over the course of 1000 h, which simulates heating by the sun during the prolonged operation of flying devices. After warming to 85° C. over 1000 h, the relative elongation and fracture toughness of the lithium-containing alloys treated according to this method drop by 25–30%.

According to the invention, a procedure for achieving the set task encompasses the following steps:

heating the material to a temperature of 400 to 500° C.

quenching in water or air, stretch-adjusting the material with a ductility of up to 2%, and artificial ageing, wherein artificial ageing takes place in 3 stages, of which the third ageing stage takes place at 90 to 110° C. over the course of 8 to 14 h.

As an alternative to executing the third ageing stage at a constant temperature, the latter can also be executed in such a way that cooling takes place for 10 to 30 h at a cooling rate of 2 to 8° C. per hour.

It has been found that alloys according to the invention with the feature of claim 1 exhibit particularly advantageous characteristics in terms of the problem definition if they are treated according to the aforementioned procedure.

Because a third ageing stage is used, these heat treatment procedures ensure the thermal, stability of the alloys after prolonged storage at low temperatures due to the additional separation of the disperse phase δ'-($Al_3Li$), which is uniformly distributed in the matrix volume. The large volume of the finely distributed δ' phase reduces the Li saturation of the mixing crystal, and prevents δ' separation during storage at 85° C. for 1000 h.

In a preferred embodiment of the procedures according to claim 2 or claim 3, the first stage of artificial ageing takes place at a temperature of 80–90° C. over the course of 3–12 h, and a second stage at 110–185° C. over the course of 10–48 h.

Staying within these limits creates particularly favorable preconditions for artificial ageing, and very reliably yields results in terms of the problem definition.

Finally, a second stage of artificial ageing can alternatively take place at a temperature of 110 to 125° C. and a duration of 5 to 12 h, wherein these procedural parameters are preferably to be applied when performing the third ageing stage according to claim 3.

Embodiments

Ingots with a diameter of 70 mm were cast from the alloys whose chemical composition is presented in Table 1. The metal was melted in a resistance furnace. After homogenization (500° C., 10 h), the ingots were pressed into strips with a cross-section of 15×65 mm. The ingots were heated to a temperature of 380–450° C. before pressing. Billets made out of the strips were heated to 360–420° C. and hot-rolled to 4 mm thick sheets, which were then cold-rolled to a thickness of 2.2 mm. The cold-rolled sheets were quenched in water or air from a temperature of 400–500° C., stretched to increase ductility up to 2%, and subjected to the heat treatments specified in Table 2. The properties of the base material and welds were determined for samples cut out of these sheets (compare Table 3).

TABLE 1

| | Chemical Compositions of Analyzed Compositions | | | | | | | | | | | |
|---|---|---|---|---|---|---|---|---|---|---|---|---|
| Alloy No. | Li | Mg | Zn | Zr | Mn | Hx10$^5$ | Be | Y | Sc | Cr | Cu | Ni |
| 1 | 2.2 | 1.2 | 5.0 | — | — | — | — | — | — | 0.4 | — | — |
| 2 | 2.4 | 3.8 | 3.9 | 0.18 | 0.50 | — | — | — | — | — | 0.96 | 0.2 |

TABLE 1-continued

Chemical Compositions of Analyzed Compositions

| Alloy No. | Li | Mg | Zn | Zr | Mn | Hx10$^5$ | Be | Y | Sc | Cr | Cu | Ni |
|---|---|---|---|---|---|---|---|---|---|---|---|---|
| 3 | 1.5 | 6.0 | 0.1 | 0.15 | 0.60 | 0.9 | 0.2 | — | — | 0.12 | — | — |
| 4 | 1.9 | 5.2 | 0.8 | 0.10 | 0.01 | 4.5 | 0.001 | — | 0.01 | — | — | — |
| 5 | 1.7 | 4.1 | 1.5 | 0.30 | 0.05 | 2.5 | — | 0.25 | — | — | — | — |
| 6 | 1.6 | 5.2 | 0.6 | 0.05 | 0.80 | 2.5 | — | 0.01 | — | 0.15 | — | — |
| 7 | 1.85 | 4.8 | 0.5 | 0.09 | 0.20 | 3.5 | — | 0.50 | — | 0.50 | — | — |
| 8 | 1.55 | 4.2 | 0.1 | 0.05 | 0.10 | 2.5 | — | — | 0.30 | — | — | — |
| 9 | 1.9 | 4.7 | 0.1 | 0.15 | 0.35 | 2.5 | 0.1 | — | — | 0.01 | — | — |
| 10 | 1.5 | 4.3 | 0.3 | 0.1 | 0.40 | 3.5 | 0.1 | — | — | — | — | — |

Comment:
Alloys 1 and 2 are comparison materials
Alloys 3–10 are materials per the invention

TABLE 2

Procedure for the Heat Treatment of Analyzed Alloys

| Alloy No. | Heat Treatment No. | Heat treatment procedure |
|---|---|---|
| 3, 5, 9 | 3 | 80° C., 4 h + 185° C., 10 h + 110° C., 8 h |
| 8, 10 | 4 | 90° C., 3 h + 110° C., 48 h + 90°C., 14 h |
| 4, 7 | 5 | 85° C., 5 h + 145° C., 25 h + 110° C., 10 h |
| 6 | 6 | 85° C., 12 h + 120° C., 12 h + 90° C., 12 h |

TABLE 3

Properties of Analyzed Alloys

| Alloy No. | Heat Treatment No. | σB, MPa | σ0.2, MPa | δ, % | $K_{CO}$, MPa√ m ($w_0$ = 200 mm) Before ageing at 85° C., 1000 h | After ageing at 85° C., 100 h |
|---|---|---|---|---|---|---|
| 1 | 1 | 460 | 345 | 3.5 | 59.5 | 46.0 |
| 2 | 2 | 470 | 355 | 2.5 | 58.7 | 44.8 |
| 3 | 3 | 475 | 358 | 9.0 | 69.5 | 67.0 |
| 4, 7 | 5 | 473 | 347 | 8.0 | 68.3 | 66.8 |
| 5 | 3 | 458 | 345 | 8.5 | 67.8 | 66.7 |
| 6 | 6 | 450 | 338 | 10.0 | 68.0 | 67.8 |
| 8, 10 | 4 | 452 | 340 | 9.5 | 66.8 | 65.9 |
| 9 | 3 | 460 | 345 | 9.0 | 65.5 | 63.3 |

Comments:
Alloys and Procedures 1 and 2 are comparison materials from a 2-stage heat treatment procedure.
Alloys and Procedures 3–10 are per the invention.

What is claimed is:

1. Aluminum-based alloy, which comprises lithium, magnesium, zinc, zirconium, scandium and manganese, characterized by additionally comprising hydrogen and at least one element selected from the group consisting of beryllium and yttrium, in the following amounts in % by weight

| | |
|---|---|
| Lithium | 1.5–1.9 |
| Magnesium | 4.1–6.0 |
| Zinc | 0.1–1.5 |
| Zirconium | 0.05–0.3 |
| Manganese | 0.01–0.8 |

-continued

| | |
|---|---|
| Scandium | 0.01–0.3 |
| Hydrogen | $0.9 \times 10^{-5}$–$4.5 \times 10^{-5}$ |

and said at least one element selected from the following group:

| | |
|---|---|
| Beryllium | 0.001–0.2 |
| Yttrium | 0.01–0.5, |
| Aluminium | Remainder. |

2. The alloy of claim 1, further comprising at least one additional element selected from the group consisting of chromium and copper.

3. The alloy of claim 1, which is heat treated stretched, and artificially aged in three stages in which the alloy is heated in the second stage at a higher temperature than the first and in the third stage is heated to a temperature of 90 to 100° C. for 8 to 14 hours or is cooled for 10 to 30 hours at a cooling rate of 2–8° C. per hour.

* * * * *

UNITED STATES PATENT AND TRADEMARK OFFICE

CERTIFICATE OF CORRECTION

PATENT NO. : 6,461,566 B2
DATED : October 8, 2002
INVENTOR(S) : Thomas Pfannenmüller et al.

It is certified that error appears in the above-identified patent and that said Letters Patent is hereby corrected as shown below:

Title page,
Item [73], Assignee, "KR" should read -- RU --.

Signed and Sealed this

Twenty-fifth Day of March, 2003

JAMES E. ROGAN
*Director of the United States Patent and Trademark Office*